US007032339B1

(12) United States Patent
Bounds

(10) Patent No.: US 7,032,339 B1
(45) Date of Patent: Apr. 25, 2006

(54) LATERAL PROJECTION MUZZLE BRAKE

(76) Inventor: Roger Bounds, 8581 108th St., Noble, OK (US) 73068

( * ) Notice: Subject to any disclaimer, the term of this patent is extended or adjusted under 35 U.S.C. 154(b) by 0 days.

(21) Appl. No.: 10/952,582

(22) Filed: Sep. 27, 2004

(51) Int. Cl.
*F41A 21/00* (2006.01)

(52) U.S. Cl. ..... 42/1.06; 89/14.3; 89/14.4

(58) Field of Classification Search ..... 42/1.06; 89/14.3, 14.4
See application file for complete search history.

(56) References Cited

U.S. PATENT DOCUMENTS

| | | | | |
|---|---|---|---|---|
| 3,707,899 | A | 1/1973 | Perrine | |
| 4,459,895 | A | 7/1984 | Mazzanti | |
| 4,545,285 | A | 10/1985 | McLain | |
| 4,562,767 | A | 1/1986 | Janssen | |
| 5,509,345 | A | 4/1996 | Cyktich | |
| 5,612,504 | A | 3/1997 | Stitt | |
| 5,811,714 | A | 9/1998 | Hull | |
| 6,216,578 | B1 | 4/2001 | Ledys | |
| 6,269,727 | B1 | 8/2001 | Nigge | |
| 6,276,251 | B1 | 8/2001 | Downing | |
| 6,425,310 | B1 | 7/2002 | Champion | |
| 6,722,254 | B1 | 4/2004 | Davies | |
| 6,820,530 | B1 * | 11/2004 | Vais | 89/14.3 |

FOREIGN PATENT DOCUMENTS

GB 2190474 * 11/1987

OTHER PUBLICATIONS

"The king of .50 caliber sniper rifles-Barrett M82A1" (hereinafter "Barrett M82A1"), http://www.gb-tech.com.tw/M82A1_E.htm, pp. 1-5.*
"Olive-Drab", http://www.olive-drab.com/od_other_firearms_rifle _m107.php.*
"Military.com", http://www.military.com/soldiertech/0,14632,Soldiertech_13 XM109,,00.html.*

* cited by examiner

*Primary Examiner*—J. Wodrow Eldred
(74) *Attorney, Agent, or Firm*—Randal D. Homburg

(57) ABSTRACT

An improved muzzle brake, attached to the end of a rifle barrel reducing the recoil of the rifle includes an internally threaded attaching end, engaging outer threads of a rifle barrel, a flattened projectile end, with an overall increasing taper from the attaching end to the projectile end, a flat upper surface which does not impede the sight line of the rifle, a flat lower surface, and two lateral surfaces including a first lateral oval vent, a second lateral oval vent and a third lateral oval vent, the first lateral vent defining a first flat brake plate having a first central bore, the second lateral oval vent defining a second flat brake plate having a second central bore and the third lateral oval vent defining a third flat brake plate having a third central bore penetrating through the projectile end, wherein a bullet fired from the rifle travels through the attaching end, the first central bore, second central bore and third central bore, while the gasses generated by the fired projectile are deflected laterally by the first flat brake plate, second flat brake plate and third flat brake plate, forcing the rifle forward, reducing the recoil force of the fired rifle.

1 Claim, 3 Drawing Sheets

LATERAL PROJECTION MUZZLE BRAKE

CROSS REFERENCE TO RELATED APPLICATIONS

None

I. BACKGROUND OF THE INVENTION

1. Field of Invention

An improved muzzle brake, attached to the end of a rifle barrel reducing the recoil of the rifle includes an internally threaded attaching end, engaging outer threads of a rifle barrel, a flattened projectile end, with an overall increasing taper from the attaching end to the projectile end, a flat upper surface which does not impede the sight line of the rifle, a flat lower surface, and two lateral surfaces including a first lateral oval vent, a second lateral oval vent and a third lateral oval vent, the first lateral vent defining a first flat brake plate having a first central bore, the second lateral oval vent defining a second flat brake plate having a second central bore and the third lateral oval vent defining a third flat brake plate having a third central bore penetrating through the projectile end, wherein a bullet fired from the rifle travels through the attaching end, the first central bore, second central bore and third central bore, while the gasses generated by the fired projectile are deflected laterally by the first flat brake plate, second flat brake plate and third flat brake plate, forcing the rifle forward, reducing the recoil force of the fired rifle.

2. Description of Prior Art

The following United States patents were discovered and are disclosed within this application for utility patent. All relate to muzzle brakes for use on the end of a rifle to counter the recoil forces of a rifle when fired. However, none of the previously disclosed patents contain the same elements nor provide the same material function of the elements as the present invention.

A most recent U.S. Pat. No. 6,722,254 to Davies discloses a muzzle brake having a single internal chamber with a plurality of lateral, twisted slots and a single flat wall which deflects the combustion gasses back and through the plurality of slots, allowing the projectile to exit through the bore opening in the flat wall. Other related prior art patents include U.S. Pat. No. 5,811,714 to Hull and U.S. Pat. No. 6,269,727 to Nigge, both having single wall deflection means with a single bore hole after the end of the rifle barrel, with Hull having three lateral projections from a single undivided chamber.

U.S. Pat. No. 4,545,285 to McLain and U.S. Pat. No. 3,707,899 to Perrine both indicate single chamber muzzle brakes attached to the end of a rifle, but they divert the combustion gasses at a backwards angle, towards the rifle at an angle and not at a direct lateral deflection. In U.S. Pat. No. 6,425,310 to Champion, a plurality of plenum members attached in alignment with a common central bore, having multiple conical recesses to divert gasses through plenum chambers to a reaction wall surface to generate the anti-recoil forces.

Two prior patents bear the most similarity, but are still greatly distinguished from the present invention. In U.S. Pat. No. 6,216,578 to Ledys, and U.S. Pat. No. 6,276,251 to Downing, indicate muzzle brakes with two transverse surfaces, or brake surfaces, where combustion gasses are deflected backwards at a rear angle, with the two surfaces appearing to be equally spaces apart and the holes within the surfaces appear to be of the same diameter, just lightly larger than the bore of the rifle barrel and slightly larger than the bullet being fired through the bores. They are not of a decreasing diameter, and the surfaces are not increasingly spaced apart through the multi-chambered bore. They also do not deflect the gasses in perpendicular alignment to the firing path, and do not appear to restrict the gas expulsion in the lateral, allowing the gasses to be directed upward and downward, and they also appear to restrict the sight plane of the rifle, to some extent, not providing upper and lower flat outer surfaces.

II. SUMMARY OF THE INVENTION

As demonstrated in the prior art, those shooting rifles or other firearms have sought a solution to the recoil forces of firearms for several years. Many muzzle brakes which attach to the end of a firearm have been provided to deflect combustion gasses of bullets fired through a rifle in an attempt to create a forward force upon the rifle to counteract the rearward forces, or recoil forces, of the rifle to exert less impact and force upon the person firing the firearm. The term muzzle brake is a known term of art, as evidenced by the noted prior art.

However, many of the previous muzzle brakes, while alleviating some recoil force upon the firearm, present other problems for the person firing the weapon. First, some of the muzzle brake interfere with the sight line of the weapon, by partially blocking the barrel sight means, thus inhibiting proper aiming of the firearm. Other muzzle brakes deflect the combustion gasses back towards the person firing the weapon, and thus pose risk of powder and gasses being blown back into the eye of the person firing the weapon. Muzzle brakes that deflect the gasses upwards or downwards may cause the end of the barrel of the firearm to be raised or lowered when the gasses are deflected, resulting in problems during repeated firing of the firearm in having to completely re-aim the firearm for subsequent firings of the firearm. In the muzzle brakes previously known, especially those having more than one surface within the muzzle brake to deflect the combustion gasses, none of them provide a graduated deflection of the combustion gasses within the muzzle brake by three reduced diameter bores in the plural surfaces, while having an increasing distance between three brake surfaces along the path of projection, with the gasses deflected equally in opposing lateral directions, helping to maintain the end of the firearm in a level position for repeated firing.

It is therefore the objectives of the invention to provide a muzzle brake with a flat upper and lower surface to mot impede the sight line of the firearm, to provide the muzzle brake with three brake surfaces of increasing distance from one another subsequent to the end of the rifle barrel, the three brake surfaces having decreasing diameter bores, to provide the three lateral bore to eliminate the combustion gasses equally out both lateral sides of the muzzle brake and not in upward or downward direction, and not in a rearward direction to reduce the risk of the combustion gasses and debris being directed into the eye of the person firing the rifle, the muzzle brake being threaded onto the end of the rifle barrel for application and removal. It is also the objective of the present muzzle brake to provide the device in one singular component without any moving or assembled components for simplicity of manufacture, cleaning and maintenance.

III. DESCRIPTION OF THE DRAWINGS

The following drawings are submitted with this utility patent application.

IV. DESCRIPTION OF THE PREFERRED EMBODIMENT

Figure 1:
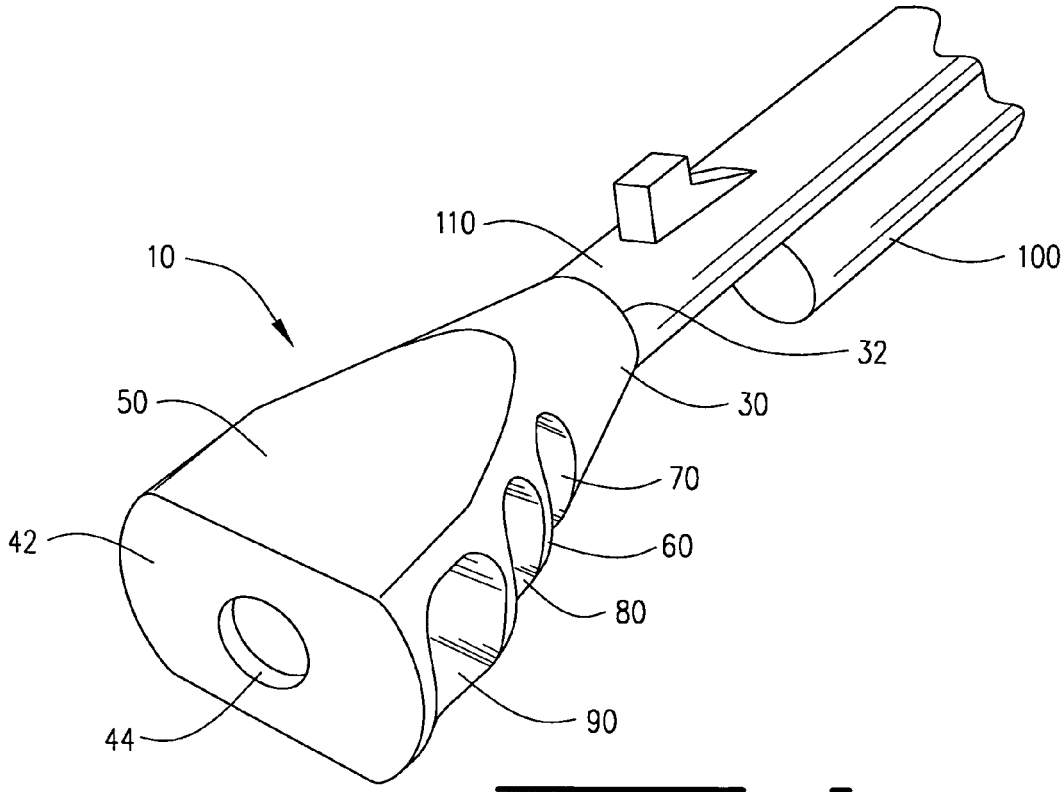
FIG. 1 is a front perspective view of the muzzle brake on the end of a rifle.
Figure 2:
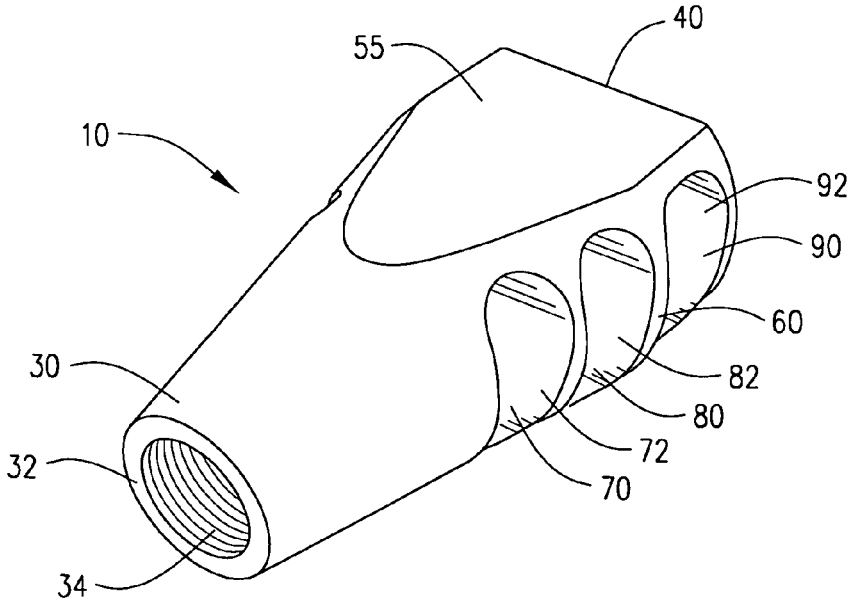
FIG. 2 is a lower rear perspective view of the muzzle brake.
Figure 3:
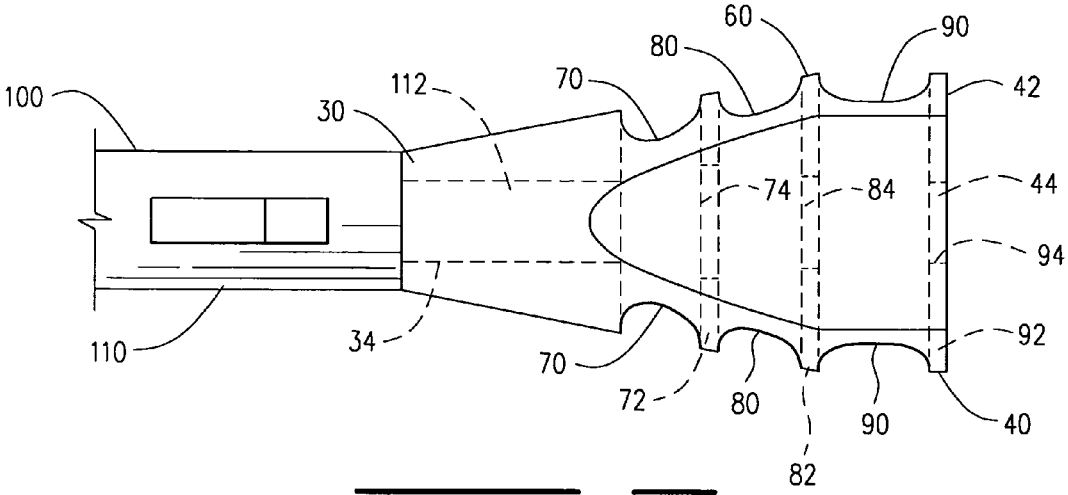
FIG. 3 is an upper view of the muzzle brake on the end of a rifle.
Figure 4:
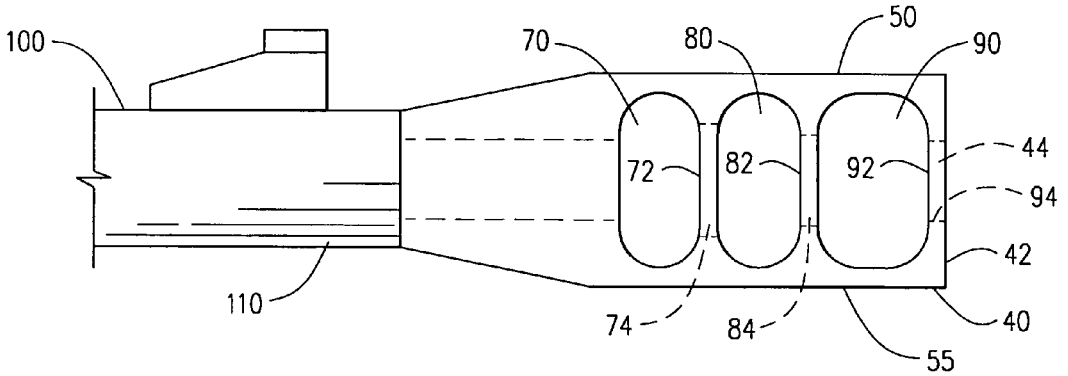
FIG. 4 is a side view of the muzzle brake on the end of a rifle.
Figure 5:
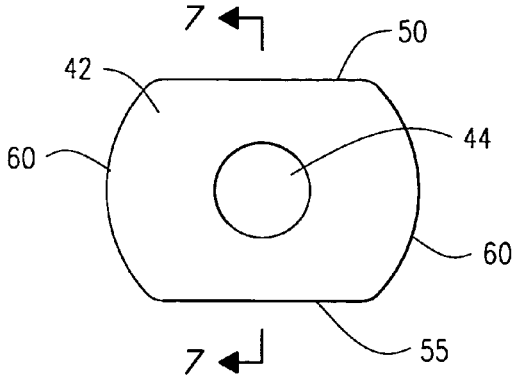
FIG. 5 is a front view of the muzzle brake.
Figure 6:
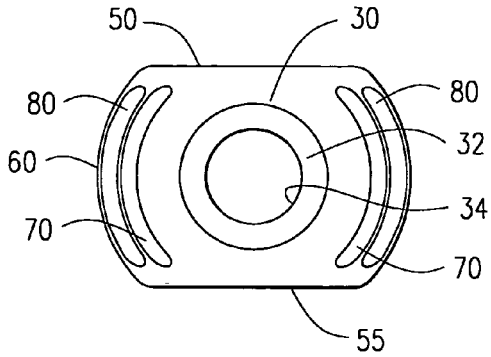
FIG. 6 is a rear view of the muzzle brake.

An improved muzzle brake 10 for application to the end 112 of a barrel 110 of a firearm 100, to provide a forward force to counteract the recoil force of the firearm 100 during firing, shown in FIGS. 1–7 of the drawings, comprises a tapered body 20 having a narrowed first end 30 including an attachment opening 32 having internal machine threads 34 adapted to engage external machine threads on the end 112 of the barrel 110 of the firearm 100, an expanded second end 40, having a flattened outer surface 42 with a central projectile bore 44, a flat upper surface 50 which does not impede the line of sight of the firearm 100 and a flat lower surface 55, the body 20 further providing two lateral sides 60 through which are provided a first lateral oval vent 70 defining a first flat brake plate 72 having a first central bore 74, a second lateral oval vent 80 defining a second flat brake plate 82 having a second central bore 84 and a third lateral oval vent 90 defining a third flat brake plate 92 having a third central bore 94 penetrating through the central projectile bore 44, wherein a bullet fired from the firearm 100 through the attached muzzle brake 10 travels through the attachment opening 32, the first central bore 74, the second central bore 84 and the third central bore 94 through the central projectile bore 44, while combustion gasses generated by the fired bullet are deflected laterally by the first flat brake plate 72, second flat brake plate 82 and the third flat brake plate 92 through the respective first, second and third lateral oval vents 70, 80, 90, forcing the firearm 100 forward, reducing the recoil forces of the fired bullet.

Figure 7:
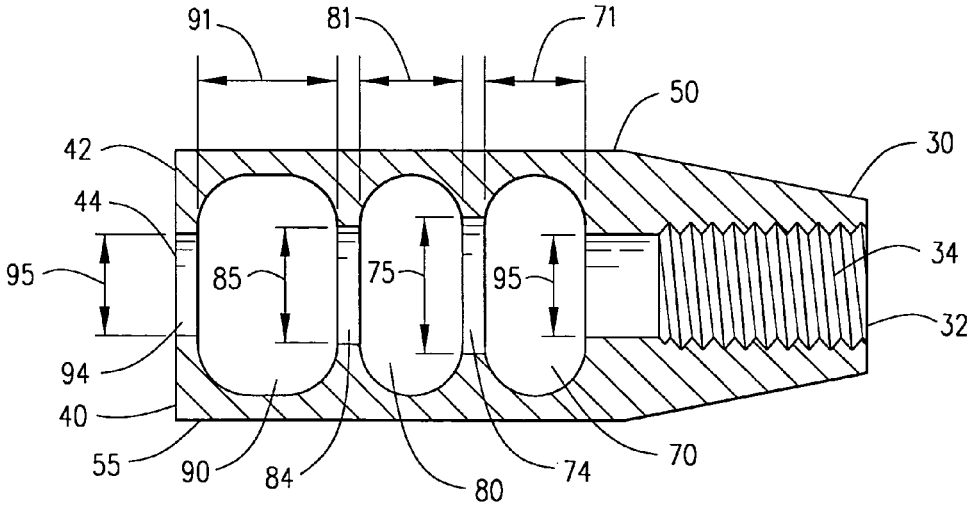
FIG. 7 is a side cross-sectional view of the muzzle brake.

As shown in FIG. 7, the body 20 further provides the attachment opening 32, the third central bore 94 and the central projectile bore 44 having a third diameter 95, the central projectile bore 44 and third central bore 94 being of common and shared bore. Most preferred, this third diameter 95 is slightly larger than the caliber of the bullet fired from the firearm. A second diameter 85 of the second central bore 84 is larger than the third diameter 95 of the third central bore 94. A first diameter 75 of the first central bore 74 is larger than the second diameter 85 of the second central bore 84, thus providing the central bores to each carve off and deflect a portion of the combustion gasses and deflecting them directly laterally out both lateral sides 60 of the muzzle brake 10, not in upward or downward direction, and not in a rearward direction to reduce the risk of the combustion gasses and debris being directed into the eye of the person firing the firearm as the bullet passes through each respective central bore and to eliminate upward or downward movement of the firearm. Also, FIG. 7 demonstrates that the third lateral oval vent 90 has a third width 91 larger than a second width 81 of the second lateral oval vent 80, and the second width 81 of the second lateral oval vent 80 is greater than a first width 71 of the first lateral oval vent 70 allowing for a graduated elimination of the combustion gasses as the bullet passes through the muzzle brake.

Most preferably the improved muzzle brake 10 is made of a single unified piece of hardened steel which is machined bored to create the first, second, and third lateral oval vents 70, 80, 90, machine drilled to create the first, second and third central bores 74, 84, 94, and machine threaded to create the internal machine threads 34 in the attachment opening 32. The taper of the body 20 is best created by machine lathing, as is the central projectile bore 44, once the caliber of the bullet is determined, while the flat upper and lower surfaces 50, 55 are prepared by machine grinding those surfaces after the taper is created by the lathe. The end 112 of the barrel 110 of the firearm 100 must also be modified with the external machine threads prior to installation of the muzzle brake 100 to the firearm, most preferably by a capable gunsmith.

Most useful application of this improved muzzle brake 10 would be to larger caliber rifles which have generally been know to have quite aggressive recoil forces, although it is contemplated that this muzzle brake could be adapted to any firearm 100, including handguns. While the invention has been particularly shown and described with reference to a preferred embodiment thereof, it will be understood by those skilled in the art that changes in form and detail may be made therein without departing from the spirit and scope of the invention.

What is claimed is:

1. An improved muzzle brake for application to an end of a barrel of a firearm, to provide a forward force to counteract recoil forces of said firearm during firing, comprises:

a tapered body;

a narrowed first end including an attachment opening having internal machine threads adapted to engage external machine threads on said end of said barrel of said firearm;

an expanded second end defining a flattened outer surface with a central projectile bore;

a flat upper surface;

a flat lower surface; and two lateral sides forming a first lateral oval vent defining a first flat brake plate having a first central bore, a second lateral oval vent defining a second flat brake plate having a second central bore and a third lateral oval vent defining a third flat brake plate having a third central bore penetrating through to said central projectile bore, said attachment opening, said central projectile bore and said third central bore having a third diameter, said second central bore having a second diameter larger than said third diameter of said third central bore, and said first central bore having a first diameter larger than said second diameter of said second central bore and said third lateral oval vent having a third width larger than a second width of said second lateral oval vent, and said second width of said second lateral oval vent is greater than a first width of said first lateral oval vent, wherein a bullet fired from said firearm through said attached muzzle brake travels through said attachment opening, said first central bore, said second central bore and said third central bore through said central projectile bore, while deflecting combustion gasses generated by said bullet laterally by said first flat brake plate, said second flat brake plate and said third flat brake plate through said respective first, second and third lateral oval vents, resulting in a graduated elimination of said combustion gasses in a direct lateral direction as said bullet passes through said muzzle brake, forcing said firearm forward, reducing said recoil forces of said fired bullet.

* * * * *